US006079516A

United States Patent [19]

Pearson

[11] Patent Number: 6,079,516

[45] Date of Patent: Jun. 27, 2000

[54] AUTO-MATIC BACK PRESSURE RELIEF MUFFLER

[76] Inventor: James E Pearson, 9406 Glasgow Pl. #8, Westchester, Calif. 90045

[21] Appl. No.: 08/946,977

[22] Filed: Mar. 2, 1998

[51] Int. Cl.[7] ..... F01N 1/00

[52] U.S. Cl. ..... 181/254; 181/270; 181/272

[58] Field of Search ..... 181/237, 254, 181/269, 270, 272, 282, 283

[56] References Cited

U.S. PATENT DOCUMENTS 4,971,166 11/1990 Hase ..... 181/254

*Primary Examiner*—Khanh Dang

[57] ABSTRACT

A muffler for an internal combustion engine comprises: a plurality of chambers formed by a single partitioning wall inside an outer shell to be communicated with each other at the entrance and at the exit of the muffler; and a flapper-valve is provided in a communicating passage at the entrance, and a opening in the partitioning wall provide communication at the exit.

1 Claim, 1 Drawing Sheet

AUTO-MATIC BACK PRESSURE RELIEF MUFFLER

The present invention relates to a muffler, preferably for an internal combustion engine.

SUMMARY OF THE INVENTION

It is an object of the present invention to provide a muffler which is capable of overcoming the above described problem.

To this end, according to the present invention provides a muffler comprising: a communicating passages constituting member allowing a plurality of chambers formed by a single partitioning wall inside an outer shell to be communicated with each other; and a flapper-type valve provided in the communicating passage at the entry, an a opening in the partitioning provided in the communicating passage at the exit.

DESCRIPTION OF THE PREFERRED EMBODIMENTS

Referring now to the accompanying drawings, description of the embodiments will be given according to the present invention.

Figure 2:
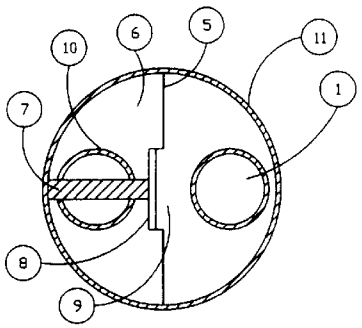
FIG. 2 is across sectional side of FIG. 1.
Figure 1:
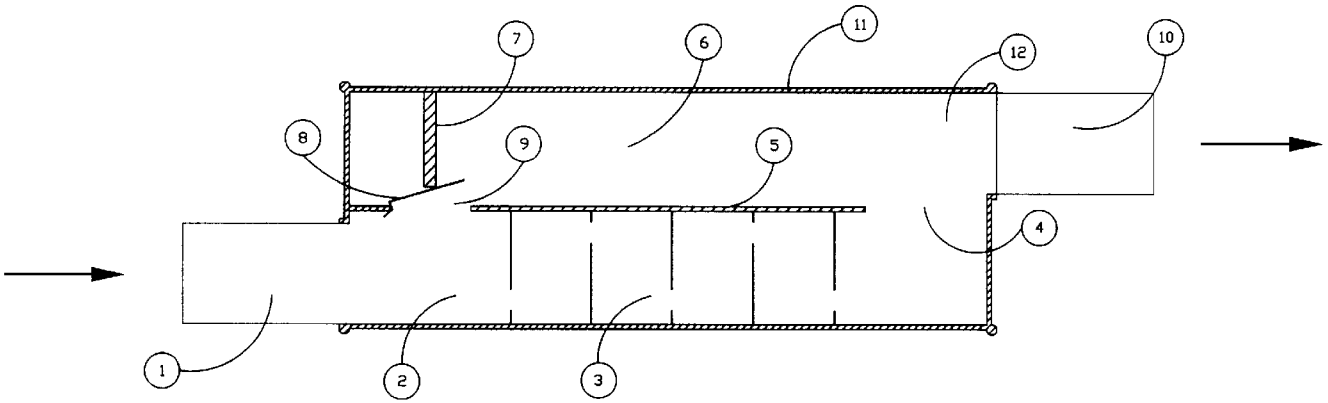
FIG. 1 is a sectional side-elevational view illustrating an embodiment of a muffler according to the present invention.

In a embodiment according to the present invention which is illustrated in FIGS. 1 and 2 the interior of an outer shell 11 is partitioned by partition wall 5 into a first chamber 2 and a second chamber 3. An end of an inlet pipe 1 is open into the first chamber 2, while an end of an outlet pipe 10 is open into the third chamber 6. An opening 4 in the partition wall 5 allows the second chamber 3 and the third chamber 6 to communicate with each other. A second opening 9 is arranged in the partitioning wall 5. Thus, a passage by which the first chamber 2 and the third chamber 6 communicates is formed. A flapper-type valve 8 for controlling communication between the first chamber 2 and third chamber 6, and is provided in the opening 9. The valve 8 is driven by a member 7 provided in the inside of the outer shell 11.

In accordance with the above described arrangement of the invention, with the valve 8 closed, the first chamber 2 serves as a accumulator chamber, and an exhaust gas from the accumulator 2 flows into the second chamber 3 through the opening 4 passes through vacuum section 12, and discharges through the output pipe or exit 10.

In addition, with the valve 8 opened, the first chamber 2 serves as an accumulator chamber, and a part of the exhaust gas from the inlet pipe 1 passes through the first chamber 2, the opening 9, and the third chamber 6.

As described above, according to the present invention, when the engine rotational speed is low and the load is light, all chambers disposed in the muffler can be used as a low-frequency resonance chambers to enhance the characteristics of damping the low-frequency sound. Meanwhile, when the engine rotational speed is high and the load is heavy, the low-frequency resonance chamber 6 can be converted into an expansion chamber to reduce the back pressure and improve the engine output. In addition, since the opening and closing valve for converting the aforementioned chamber into either the low-frequency resonance chamber or the expansion chamber is of the flapper type, it is possible to reduce the circulation resistance of the exhaust gas passing through the opening and closing valve when the valve is fully opened, thereby allowing the back pressure to be further reduced.

What is claimed is:

1. A muffler comprising:

an outer shell enclosing an interior space;

a wall longitudinally partitioning said interior space into a first chamber, a second chamber communicating with said first chamber, and a third chamber;

a plurality of baffles provided inside said second chamber;

an exhaust gas inlet extending into said first chamber;

an exhaust gas outlet extending into said third chamber;

a first opening provided in said wall, said first opening is provided with a valve for controlling communication between the first and third chambers; and a second opening provided in said wall for providing communication between the second and third chambers.

* * * * *